United States Patent [19]

Beer et al.

[11] 4,326,791

[45] Apr. 27, 1982

[54] TRANSPORT SYSTEM FOR PROCESSOR OF PHOTOSENSITIVE WEB MATERIAL

[75] Inventors: Robert E. Beer; Conrad V. Anderson, both of Minneapolis, Minn.

[73] Assignee: Pako Corporation, Minneapolis, Minn.

[21] Appl. No.: 215,690

[22] Filed: Dec. 12, 1980

[51] Int. Cl.[3] ..... G03D 3/13

[52] U.S. Cl. ..... 354/321; 226/184; 226/189

[58] Field of Search ..... 354/316, 319, 320, 321, 354/322; 134/64 P, 122 P; 226/189, 184

[56] References Cited

U.S. PATENT DOCUMENTS

| | | | |
|---|---|---|---|
| 3,760,705 | 9/1973 | Miller | 354/322 |
| 3,830,419 | 8/1974 | Lee | 226/184 |
| 3,922,701 | 11/1975 | Geyken et al. | 354/319 |
| 4,032,943 | 6/1977 | Zwettler | 354/322 |
| 4,086,607 | 4/1978 | Muller | 354/322 |
| 4,143,959 | 3/1979 | Fischer | 354/322 |
| 4,174,901 | 11/1979 | Takita et al. | 226/189 |

*Primary Examiner*—L. T. Hix
*Assistant Examiner*—Alan Mathews
*Attorney, Agent, or Firm*—Kinney, Lange, Braddock, Westman and Fairbairn

[57] ABSTRACT

A photoprocessor for photosensitive webs includes a plurality of tanks containing photoprocessing solution and a dryer. The web is transported through the tank by a plurality of opposed spaced pairs of oppositely oriented driven tapered rollers. The transport speed of the web through the tank is determined by a pair of opposed cylindrical rollers at the exit of the last tank. The cylindrical rollers are driven at a tangential velocity which is approximately equal to the tangential velocity at the centers of the tapered rollers. A loader at the inlet end of the processor includes driven and idler rollers which are normally out of engagement and which are brought into engagement to drive the web into the processor for a selected time period when the web is first sensed at the inlet end of the processor.

21 Claims, 11 Drawing Figures

TRANSPORT SYSTEM FOR PROCESSOR OF PHOTOSENSITIVE WEB MATERIAL

BACKGROUND OF THE INVENTION

1. Field of the Invention

The present invention relates to processors of photosensitive material. In particular, the present invention is an improved system for transporting photosensitive webs through processing tanks of a processor.

2. Description of the Prior Art

A wide variety of processors have been developed to process webs of photosensitive materials. These processors typically include a plurality of tanks containing photoprocessing solutions, and a dryer. The web of photosensitive material is transported through the tanks and through the dryer by a transport system which typically includes a plurality of driven rollers.

Some types of processors are required to accept webs of various widths. An example is a graphic arts processor for processing resin-coated phototype-setting paper webs. These webs can vary in width from, for example, 35 mm to 203 mm (8 inches) and may be supplied from a roll or from a light-tight cassette. The length of the phototypesetting paper webs can range from 7 inches to several hundred feet in length. This presents several difficult problems with respect to the transport system of the processor. First, in a processor adapted to be used with a wide variety of different widths of webs, it is desirable not to have to change the entire transport system each time a different width web is processed. As a result, it is impractical to provide guides within the tanks and the dryer. Thus the transport system permit the web to track reliably through the processor with guiding only at the inlet end of the processor.

Second, with long length webs, there is significant danger of damage, particularly in the event of slight angular misalignment of the web at the inlet end. In conventional transport systems, any wandering of the web can result in wrinkling or damage to the edge of the paper.

Third, in conventional transport systems the speed of the various rollers of the transport system must be closely synchronized to prevent damage or even breaking of the web as a result of stretching. Similarly, damage can occur to the web in conventional transport systems if the later rollers are operating at lower speeds than the earlier rollers, since the web may buckle or wrinkle and can, in some instances, even jam the transport.

U.S. Pat. No. 3,830,419 by Conrad E. Lee, which is assigned to the assignee of the present application, describes a transport system for photographic processors which uses tapered rollers. The transport mechanism includes a plurality of pairs of oppositely tapered rollers having opposed surfaces which are spaced apart a distance which is slightly greater than the thickness of the web. The pairs of tapered rollers are arranged so that the web is driven only on the marginal edge portions of the web. This minimizes damage to the images which are typically contained in the central portions of the web.

SUMMARY OF THE INVENTION

The present invention is an improved processor of webs of photosensitive material having a plurality of tanks for containing photoprocessing solutions. The transport system of the processor includes a plurality of opposed spaced pairs of oppositely oriented driven tapered rollers for transporting the web through the tank by engaging only portions of the web. The transport system further includes an opposed driven pacer roller pair of cylindrical rollers positioned at an exit from the last of the plurality of tanks. The pacer roller pair defines a nip for engaging and driving the web across essentially the entire width of the web. The pacer roller pair is driven at a tangential velocity which is approximately equal to the tangential velocity of the centers of the tapered rollers.

It has been discovered that with the transport of the present invention, in which the web is engaged and driven across its entire width only by the pacer roller pair, various widths of webs can be fed through the transport system with a minimum of guiding only at the inlet end of the processor. Since the web is engaged across its entire width only at the pacer roller pair, movement or angular misalignment of the web at the inlet end does not result in wrinking, tearing or other damage to the web. In addition, variations in drive speed of the transport rollers or web speed do not create tearing or wrinkling problems which can damage the web, since the pacing of the web is controlled by the pacer roller pair, and the web is not engaged across its entire width by any of the tapered rollers preceding the pacer roller pair.

In a preferred embodiment of the present invention, self-threading of the web into the processor is provided by driven and idler cylindrical rollers at the inlet end of the processor. The driven and idler rollers are normally out of engagement with one another. When the leading edge of a web is sensed at the inlet end of the processor, the driven and idler cylindrical rollers are brought into engagement for a selected time period so as to drive the web into the processor. The selected time period is sufficient to feed the leading end of the web into the tapered roller portion of the transport system so that the tapered rollers provide sufficient friction to continue to pull the web through the processor. The driven and idler rollers have greater pulling power than the tapered rollers, since they engage and pinch the web across the entire width of the web. The driven and idler rollers are moved to their normal position out of engagement with one another at the end of the selected time period, which is before the leading end of the web reaches the pacer roller pair.

DETAILED DESCRIPTION OF THE PREFERRED EMBODIMENTS

Figure 1:
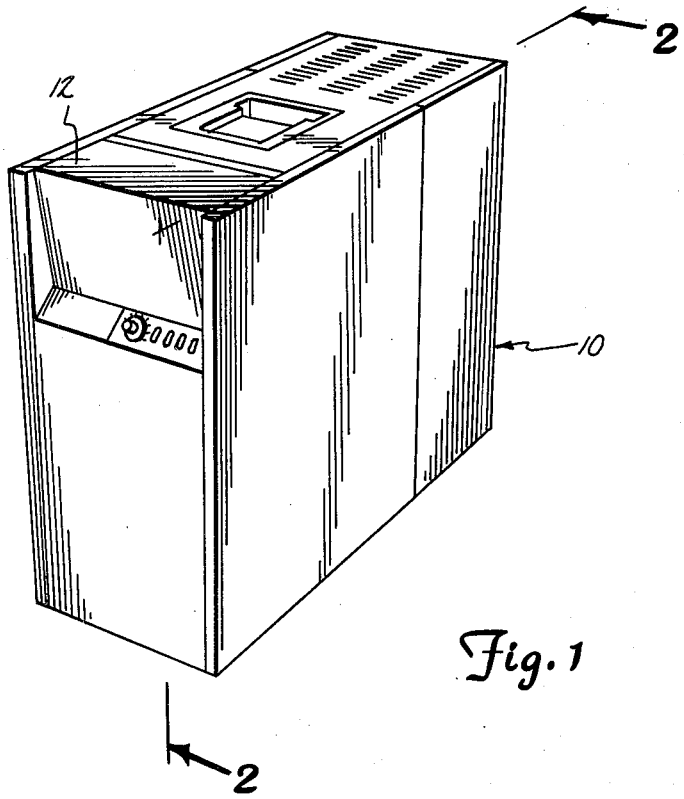
FIG. 1 is a perspective view showing a photoprocessor which utilizes the web transport system of the present invention.

FIG. 1 shows graphic arts processor 10 which utilizes the web transport system of the present invention. Processor 10 includes daylight loader box 12 within which webs of photosensitive material may be fed from cassettes, so as to permit processor 10 to operate in normal daylight conditions.

Figure 2:
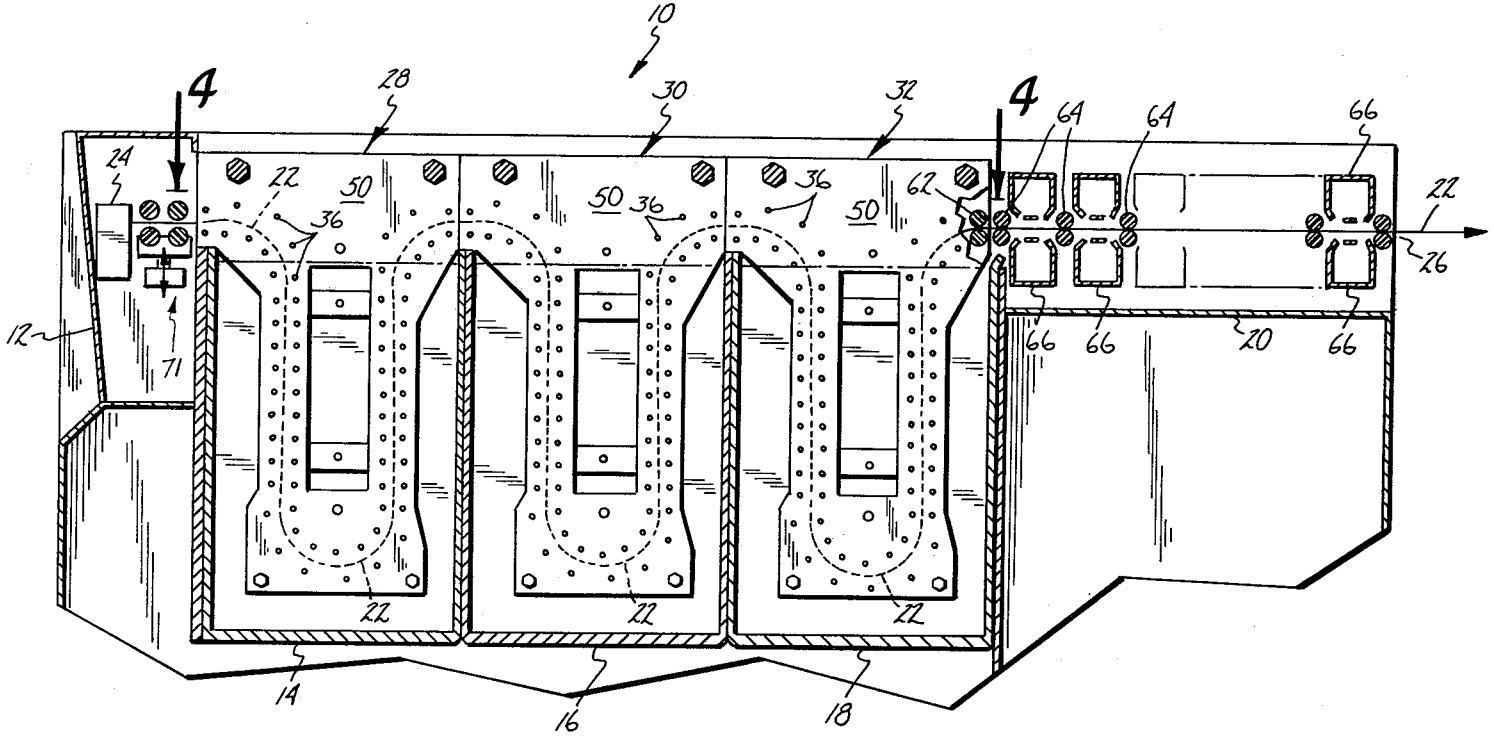
FIG. 2 is a sectional view along section 2—2 of the transport system of the processor of FIG. 1.

As shown in FIG. 2, processor 10 includes developer tank 14, fix tank 16, wash tank 18, and dryer 20. Web 22 of photosensitive material is transported from cassette 24 which is positioned within loader 12 (or from a roll of photosensitive material) through tanks 14, 16 and 18 and then through dryer 20. Web 22 exits dryer 20 and processor 10 through opening 26 at the rear end of processor 10.

Figure 3:
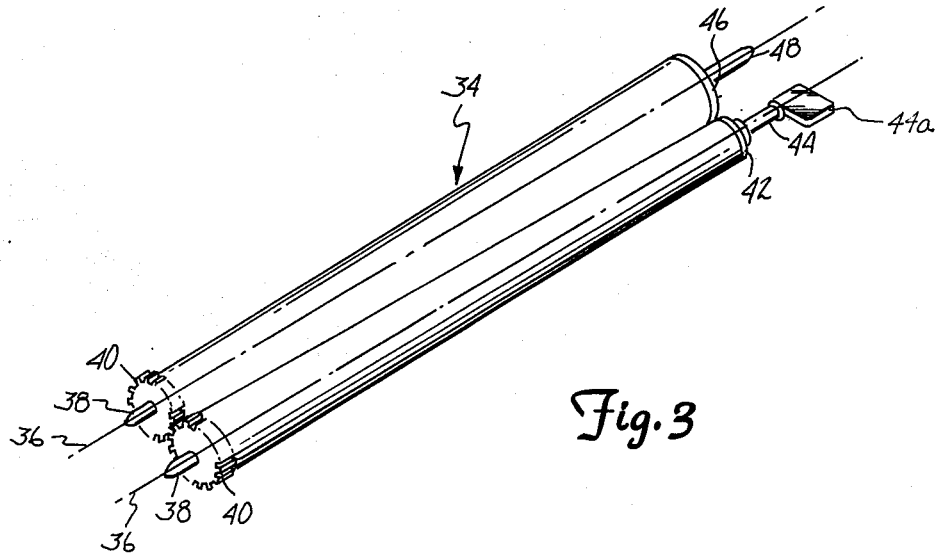
FIG. 3 is a perspective view showing a pair of tapered rollers used in the transport system of FIG. 2.

The transport system illustrated in FIG. 2 consists of rack 28 in developer tank 14, rack 30 in fix tank 16, and rack 32 in wash tank 18. Each rack 28, 30 and 32 is removable from its respective tank 14, 16 and 18 for repair, cleaning and the like. Each rack 28, 30 and 32 includes a plurality of opposed pairs of driven tapered rollers 34, as illustrated in FIG. 3. Rollers 34 are spaced apart so that a web being transported between rollers 34 is not engaged across its entire width. Rollers 34 rotate about axes 36. At one end of each roller 34 are mounted spindle 38 and gear 40. At the opposite end of one of the rollers 34 is plug 42, which receives roller crank pin 44; and at the opposite end of the other roller 34 is plug 46, which receives idler pin 48.

Figure 4A:
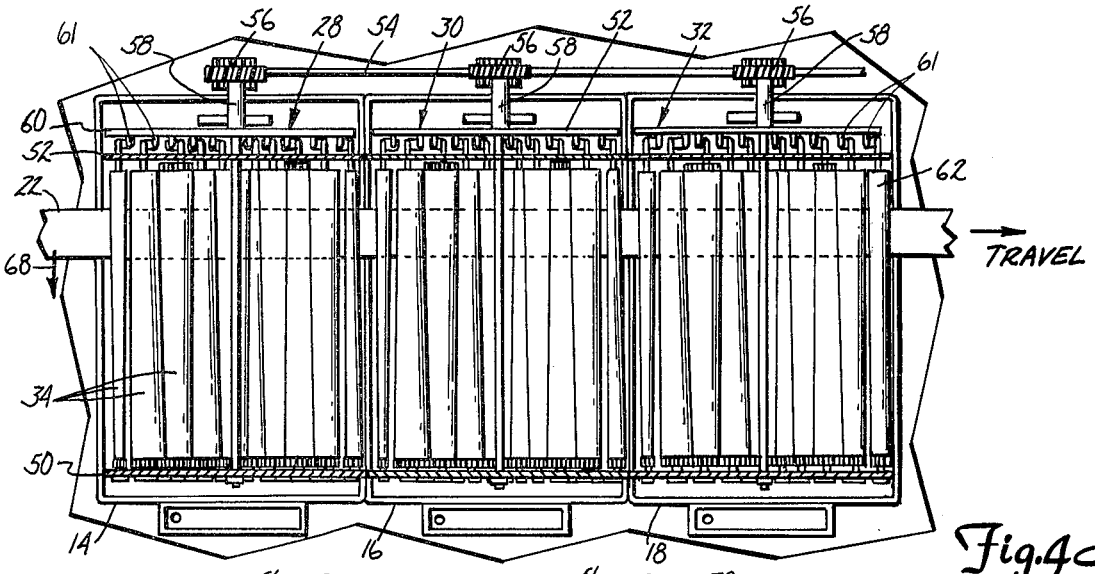
FIGS. 4A, 4B and 4C are top sectional views along section 4—4 of the transport system of FIG. 2, illustrating a self-tracking feature of the transport system of the present invention.
Figure 4B:
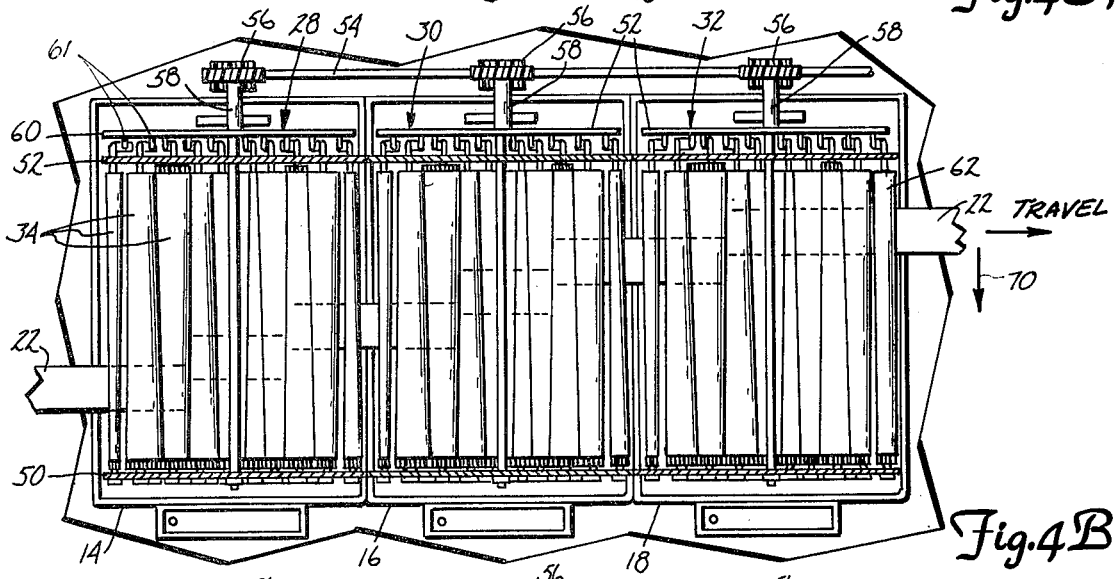
Figure 4C:
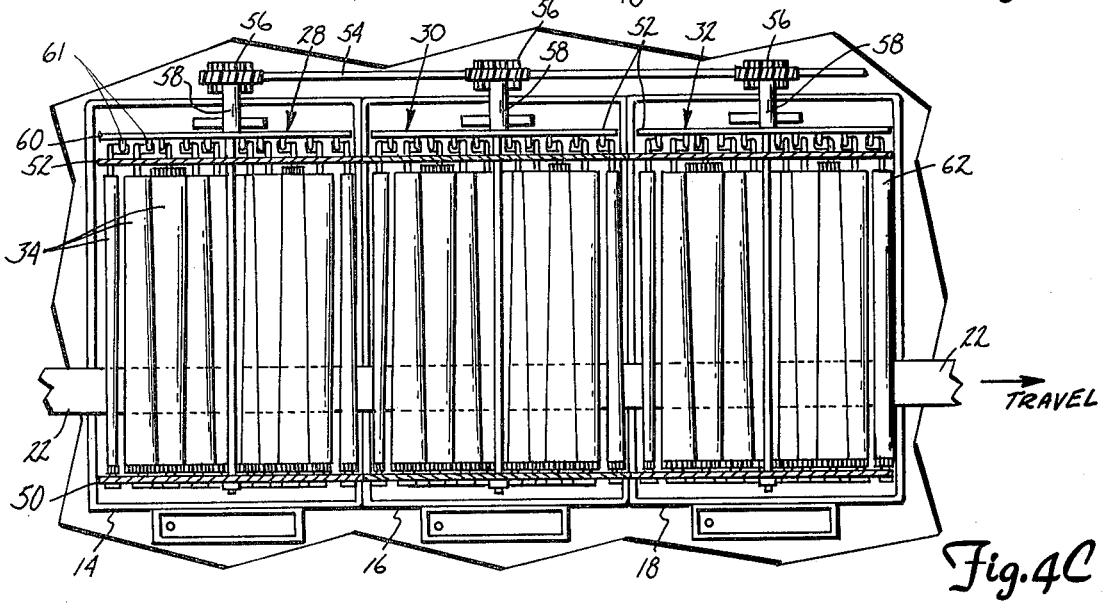

Each pair of tapered rollers 34 is mounted between rack end plates 50 and 52 shown in FIGS. 4A–4C. The locations of axes 36 of rollers 34 are illustrated by dots on opposite sides of the path of web 22 in FIG. 2. Drive to the tapered rollers 34 is applied from drive shaft 54 through gears 56 and input drive shafts 58 to orbiting plates 60. Each orbiting plate 60 has a plurality of drive pins 61 which engage the flag portions 44*a* of drive crank pins 44 to rotate crank pins 44 and therefore rollers 34.

Racks 28 and 30 are identical in construction. All of the sets of rollers in racks 28 and 30 are tapered roller pairs 34. The orientation of the tapered roller pairs is alternated throughout the path defined in racks 28 and 30 which creates a zigzag path for the marginal edges of web 22 as it is transported through racks 28 and 30. The size of the tapered roller pairs differs depending upon the position of the tapered roller pairs in the rack 28 or 30. In particular, the outer tapered rollers at the curved portions of the path preferably are larger in diameter than the inner tapered rollers, but have the same degree of taper. The use of larger outer tapered rollers at each curve assists in guiding web 22 along the desired curved portion of the path.

Figure 5:
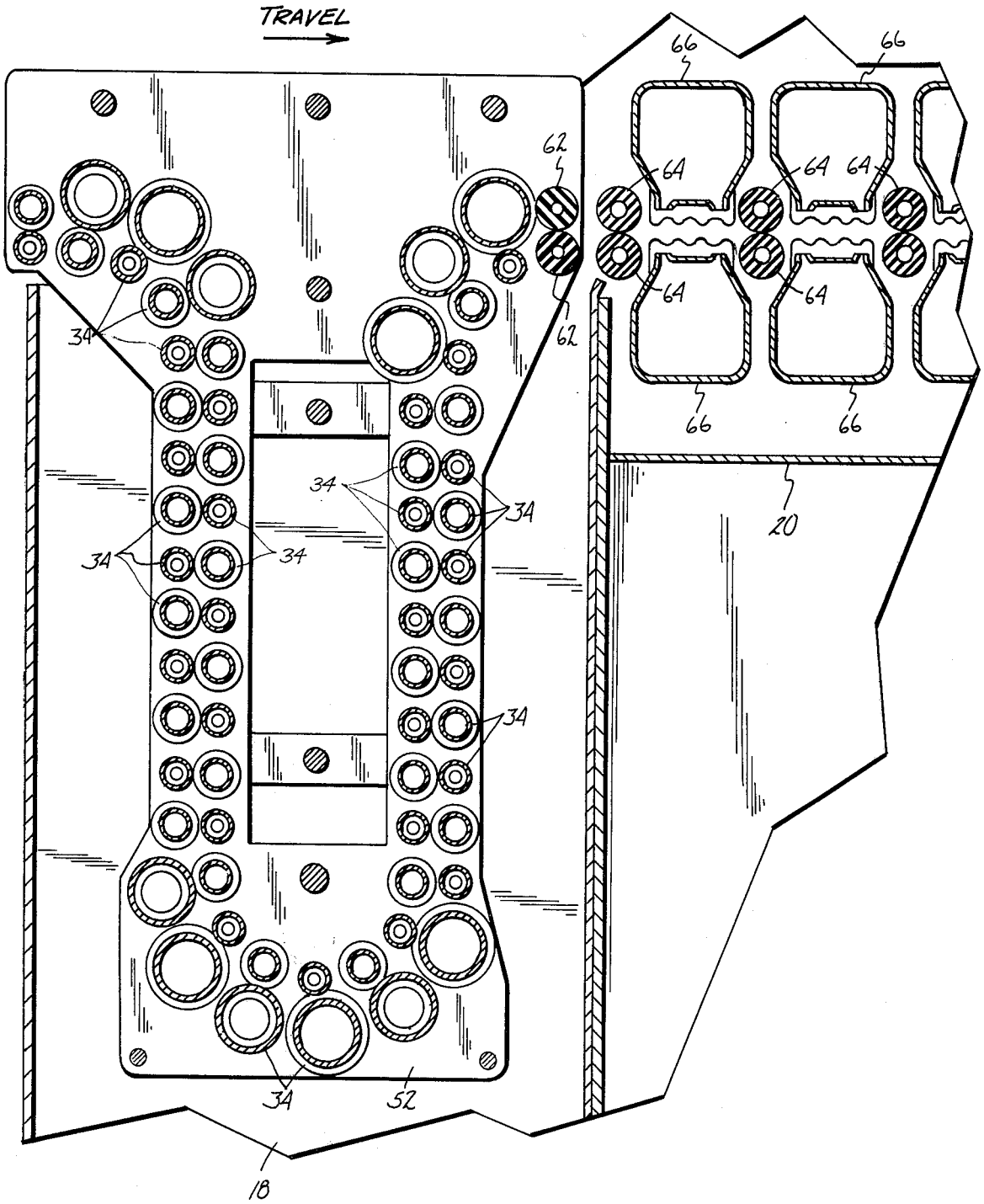
FIG. 5 is a sectional view showing the wash tank transport rack and a portion of the dryer of the transport system of FIG. 2.
Figure 6:
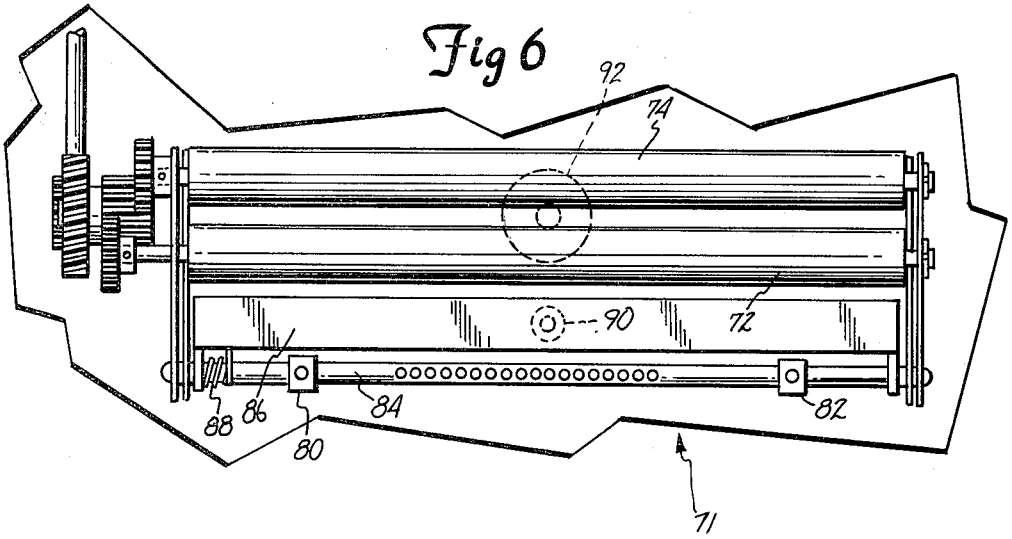
FIGS. 6 and 7 are top and front views, respectively, of the loader assembly used in the transport system of FIG. 2.
Figure 8A:
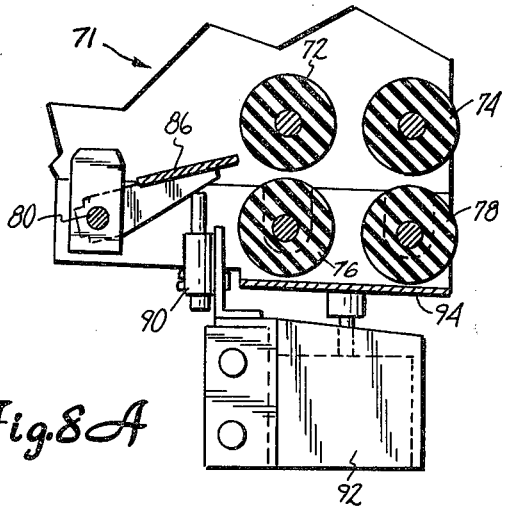
FIGS. 8A and 8B are sectional views of the transport system of FIGS. 6 and 7 illustrating operation of the loader assembly.
Figure 8B:
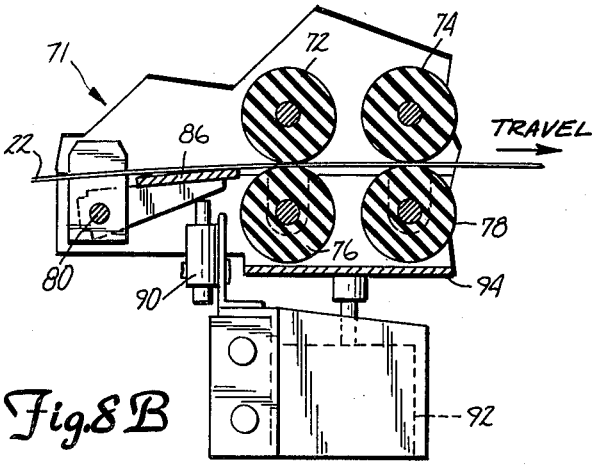
Figure 7:
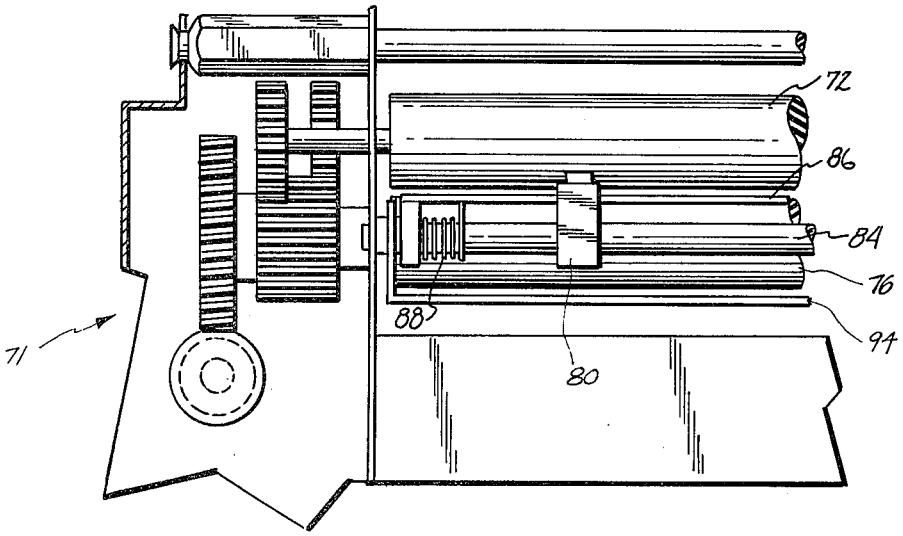

As shown in FIGS. 2 and 5, rack 32 is identical to racks 28 and 30 except for roller pair 62 at the exit end of rack 32. Unlike all of the preceding rollers in racks 28, 30 and 32, roller pair 62 is a pair of cylindrical squeegee rollers which define a nip for engaging and driving web 22 across essentially the entire width of web 32. Roller pair 62 is driven at a tangential velocity which is approximately equal to the velocity at the centers of any of the tapered roller pairs 34 within racks 28, 30 and 32, and acts a pacer for the transport system.

As web 22 exits wash tank 18, it is transported through dryer 20 by opposed cylindrical roller pairs 64. Air ducts 66 positioned both above and below web 22 direct heated air onto the upper and lower surfaces of web 10.

It has been discovered that the transport system of the present invention, which utilizes tapered rollers 34 in the transport racks together with a cylindrical pacer roller pair 62 at the outlet end of the last rack 32 has several important advantages. In particular, the transport system of the present invention is capable of transporting a wide variety of different widths of webs 22 without requiring any guides within tanks 14, 16 or 18 or in dryer 20. The transport system of the present invention exhibits a unique self-tracking feature which is further illustrated in FIGS. 4A–4C.

In FIG. 4A, web 22 is shown which has a width which is substantially less than the total width of racks 28, 30 and 32. In FIG. 4A, web 22 is aligned throughout the racks and is closer to rack end plates 52 than to rack end plates 50.

Because web 22 is not engaged across its entire width except at pacer roller pair 62, it is possible to move web 22 laterally at the inlet end of the transport system. In FIG. 4A, arrow 68 illustrates the direction in which the web 22 is about to be moved. In FIG. 4B, web 22 has been moved to a position which is closer to rack end plate 50 at the inlet end of the transport system. As shown in FIG. 4B, the web 22 initially remains at its original position at the outlet end, and the transport system accommodates this misalignment between the inlet and outlet ends of web 22 without breaking or otherwise damaging web 22. As illustrated by arrow 70 in FIG. 4B, once a misalignment between inlet and outlet positions of web 22 occurs, web 22 at the outlet end begins to move to match its position with the position of web 22 at the inlet end. FIG. 4C illustrates web 22 after it has once again become aligned between the inlet and outlet ends. Each time the position of web 22 at the inlet end changes, the position of web 22 at the outlet end begins to creep until it is once again aligned with the inlet end position. This unique self-tracking feature of the present invention accommodates slight angular misalignment of web 22 at the inlet end without any wrinkling or damage to the edge of web 22.

Another important advantage of the transport system of the present invention is that it does not require the speed of the various rollers of the transport system to be closely synchronized, and accommodates web speed differences due to web swelling, etc. The present invention achieves these advantages by setting the surface speed of pacer roller pair 62 at approximately the tangential velocity at the center of the tapered roller pairs 34 which precede it. Slight variations in speed of the tapered roller pairs and web speed changes are accommodated, since the rollers do not engage the web across its entire width. While the explanation for this advantageous feature of the present invention is not fully understood, it is believed that a change in tension on web 22 is accompanied by a corresponding change in the portions of web 22 contacting tapered rollers 34. That is, slower or faster sections of tapered roller pairs 34 are brought into contact with portions of web 22 as the needs arise. As a result, the present invention avoids damage or breaking of web 22 as a result of stretching. Similarly, buckling or wrinkling problems which are encountered in prior art transport systems are avoided with the transport system of the present invention.

FIGS. 6, 7, 8A and 8B illustrate a loader assembly 71 utilized with the transport system of the present invention. One problem encountered with the use of tapered roller transport racks is that the pulling force of the racks is relatively low, since web 22 is not engaged across its entire width, but only at portions of web 22. In particular, it has been discovered that the pulling force of rack 28 is too low to pull a narrow web 22 from cassette 24 when web 22 is first being fed into the transport system. It has also been discovered that the addition of cylindrical drive rollers ahead of pacer roller pair 62 causes transport failures.

Loader assembly 71 of FIGS. 6–8B overcomes these problems. The loader assembly of the present invention utilizes two pair of normally separated drive rollers which are mounted between loader box 12 and developer rack 28. Upper rollers 72 and 74 are driven rollers, and are fixed in position. Lower rollers 76 and 78 are idler rollers, and are positioned below upper rollers 72 and 74, respectively. The use of two pairs of upper and lower rollers provides consistant rolling force to web 22 as it is initially fed into rack 28, even in the event that one of the rollers has a defect.

Web 22 is guided into the loader by guide blocks 80 and 82 which are mounted on guide rod 84. The position of guide blocks 80 and 82 may be adjusted to accommodate different widths of web 22.

Web sensor arm 86 is pivotally mounted on guide rod 84, and is biased upwardly by torsion spring 88. The presence of web 22 causes web sensor arm 86 to be depressed, thus depressing switch 90. When sensor switch 90 initially changes state, indicating that web 22 is initially being fed into the loader assembly, solenoid 92 is actuated, thus driving bracket 94 and lower rollers 76 and 78 upward. This forms a nip contact to pull web 22 from cassette 24 and transport it into the entrance of developer transport rack 28. After a predetermined time period (which is preferably about 5 to 20 seconds), solenoid 92 is deactivated, since sufficient traction is then available in rack 28 to continue to pull web 22 from cassette 24. This eliminates any drive roller interference at the entrance end of the transport system. The time period during which solenoid 92 is actuated is a function of the properties of cassette 24 and the processor transport speed.

In conclusion, the transport system of the present invention provides significant advantages over prior art transport systems. It is capable of transporting webs of a variety of widths and lengths without damage due to wrinkling or buckling. It is self-threading, and tracks reliably with only guidance at the front end of the transport system.

Although the present invention has been described with reference to preferred embodiments, workers skilled in the art will recognize that changes may be made in form and detail without departing from the spirit and scope of the invention.

What is claimed is:

1. A processor of webs of photosensitive materials comprising:

a plurality of tanks for containing photoprocessing solutions, each tank having an entrance and an exit;

a plurality of opposed pairs of oppositely oriented driven spaced tapered rollers for transporting the web, without engaging the web across its entire width, from the entrance of a first tank of the plurality of tanks through the tanks to the exit of a last tank of the plurality of tanks;

an opposed driven pacer roller pair of cylindrical rollers defining a nip for engaging the web across its entire width and driving the web, the pacer roller pair being positioned at the exit from the last tank of the plurality of tanks, and being driven at a tangential velocity which is approximately equal to tangential velocity at centers of the tapered rollers, wherein from the entrance of the first tank to the exit of the last tank the web is engaged across its entire width only by the pacer roller pair.

2. The processor of claim 1 and further comprising:

driven cylindrical roller means at an inlet end of the processor;

idler cylindrical roller means generally opposing the driven cylindrical roller means, the idler and driven cylindrical roller means being normally out of engagement with one another;

web sensing means for sensing presence of a web at the inlet end; and means for bringing the driven and idler cylindrical roller means into engagement for a selected period to engage the web across its entire width and drive the web into the entrance of the first tank of the processor, the selected period being less than the time required for a leading end of the web to be transported to the pacer roller pair, so that both the driven and idler cylindrical roller means and the paper roller pair do not simultaneously engage the web.

3. The processor of claim 2 wherein the driven cylindrical roller means comprises a pair of driven cylindrical rollers, and wherein the idler cylindrical roller means comprises a pair of idler cylindrical rollers.

4. The processor of claim 2 wherein the idler cylindrical roller means are normally positioned out of engagement with the driven cylindrical roller means and wherein the means for bringing the driven and idler cylindrical roller means into engagement moves the idler cylindrical roller means to a position which forms a nip for engaging the web across the entire width and driving the web into the processor.

5. The processor of claim 4 wherein the driven cylindrical roller means are positioned above a path of the web, and the idler cylindrical roller means are positioned below the path of the web.

6. The processor of claim 2 further comprising:

web guiding means positioned proximate the inlet end of the processor for guiding the web between the driven cylindrical roller means and the idler cylindrical roller means.

7. The processor of claim 1 and further comprising:

dryer means for drying the web; and a plurality of opposed pairs of driven cylindrical roller means for receiving the web from the exit of the last tank and for transporting the web through the dryer.

8. In a processor of webs of photosensitive material of the type having a plurality of tanks for containing photoprocessing solutions and having a dryer for drying the web after the web has exited a last tank of a plurality of tanks, an improved transport system for transporting the webs from an entrance to a first tank to an exit of the last tank comprising:

a plurality of opposed pairs of oppositely oriented driven spaced tapered rollers for transporting the web through the tanks without engaging the web across its entire width; and an opposed driven pacer roller pair of cylindrical rollers defining a nip for engaging and driving the web across essentially the entire width of the web, the pacer roller pair being positioned at the exit from the last tank and being driven at a tangential velocity which is approximately equal to tangential velocity at centers of the tapered rollers, wherein from the entrance of the first tank to the exit of the last tank the web is engaged across its entire width only by the pacer roller pair.

9. The invention of claim 8 and further comprising:

a plurality of opposed pairs of driven rollers for transporting the web through the dryer.

10. The invention of claim 9 wherein the plurality of opposed pairs of driven rollers for transporting the web through the dryer comprise:

pairs of cylindrical rollers for engaging the web across essentially the entire width of the web.

11. The invention of claim 8 and further comprising:

loader means for engaging a leading end of the web across essentially its entire width for a time period sufficient to drive the leading end of the web into a first tank of the plurality of tanks, but insufficient for the leading end of the web to reach the opposed driven pacer roller pair.

12. The invention of claim 11 wherein the loader means comprises:

driven cylindrical roller means at an inlet end of the processor;

idler cylindrical roller means generally opposing the driven cylindrical roller means, the idler and driven cylindrical roller means being normally out of engagement with one another;

web sensing means for sensing the presence of the web at the inlet end; and means for bringing the driven and idler cylindrical roller means into engagement for the selected time period to drive the leading end of the web into the first tank.

13. A processor of webs of photosensitive materials comprising:

a plurality of tanks for containing photoprocessing solutions;

a plurality of opposed pairs of oppositely oriented driven spaced tapered rollers for transporting the web through the tanks;

an opposed driven pacer roller pair of cylindrical rollers defining a nip for engaging and driving the web, the pacer roller pair being positioned at an exit from a last tank of the plurality of tanks, and being driven at a tangential velocity which is approximately equal to tangential velocity at centers of the tapered rollers;

driven cylindrical roller means at an inlet end of the processor;

idler cylindrical roller means generally opposing the driven cylindrical roller means, the idler and driven cylindrical roller means being normally out of engagement with one another;

web sensing means for sensing presence of a web at the inlet end; and means for bringing the driven and idler cylindrical roller means into engagement for a selected period to drive the web into the processor.

14. The processor of claim 13 wherein the driven cylindrical roller means comprises a pair of driven cylindrical rollers, and wherein the idler cylindrical roller means comprises a pair of idler cylindrical rollers.

15. The processor of claim 13 wherein the idler cylindrical roller means are normally positioned out of engagement with the driven cylindrical roller means and wherein the means for bringing the driven and idler cylindrical roller means into engagement moves the idler cylindrical roller means to a position which forms a nip for engaging and driving the web into the processor.

16. The processor of claim 15 wherein the driven cylindrical roller means are positioned above a path of the web, and the idler cylindrical roller means are positioned below the path of the web.

17. The processor of claim 13 further comprising:

web guiding means positioned proximate the inlet end of the processor for guiding the web between the driven cylindrical roller means and the idler cylindrical roller means.

18. The processor of claim 13 and further comprising:

dryer means for drying the web; and a plurality of opposed pairs of driven cylindrical roller means for receiving the web from the exit of the last tank and for transporting the web through the dryer.

19. In a processor of webs of photosensitive material of the type having a plurality of tanks for containing photoprocessing solutions and having a dryer for drying the web after the web has exited a last tank of a plurality of tanks, an improved transport system comprising:

a plurality of opposed pairs of oppositely oriented driven spaced tapered rollers for transporting the web through the tank;

an opposed driven pacer roller pair of cylindrical rollers defining a nip for engaging and driving the web across essentially the entire width of the web, the pacer roller pair being positioned at the exit from the last tank and being driven at a tangential velocity which is approximately equal to tangential velocity at centers of the tapered rollers;

driven cylindrical roller means at an inlet end of the first tank;

idler cylindrical roller means generally opposing the driven cylindrical roller means, the idler and driven cylindrical roller means being normally out of engagement with one another;

web sensing means for sensing the presence of the web at the inlet end; and means for bringing the driven and idler cylindrical roller means into engagement for the selected time period to drive the leading end of the web into the first tank.

20. The invention of claim 19 and further comprising:

a plurality of opposed pairs of driven rollers for transporting the web through the dryer.

21. The invention of claim 20 wherein the plurality of opposed pairs of driven rollers for transporting the web through the dryer comprise:

pairs of cylindrical rollers for engaging the web across essentially the entire width of the web.

* * * * *